US008250821B1

(12) United States Patent
Gibson

(10) Patent No.: US 8,250,821 B1
(45) Date of Patent: Aug. 28, 2012

(54) UNDER A DECK CEILING DRAINAGE SYSTEM

(76) Inventor: George Raymond Gibson, Atlanta, GA (US)

( * ) Notice: Subject to any disclaimer, the term of this patent is extended or adjusted under 35 U.S.C. 154(b) by 337 days.

(21) Appl. No.: 12/584,242

(22) Filed: Sep. 3, 2009

Related U.S. Application Data

(60) Provisional application No. 61/194,615, filed on Sep. 29, 2008.

(51) Int. Cl.
*E04B 1/70* (2006.01)

(52) U.S. Cl. ..... 52/302.3; 52/11; 52/302.1; 52/302.6; 52/650.3

(58) Field of Classification Search ..... 52/11, 14–16, 52/302.1, 302.3, 302.6, 533, 537, 650.3
See application file for complete search history.

(56) References Cited

U.S. PATENT DOCUMENTS

| | | | | | |
|---|---|---|---|---|---|
| 3,286,404 | A * | 11/1966 | Harrison | 49/384 |
| 4,065,883 | A * | 1/1978 | Thibodeau | 52/11 |
| 4,817,343 | A * | 4/1989 | Rutledge | 52/22 |
| 4,860,502 | A * | 8/1989 | Mickelsen et al. | 52/11 |
| 5,960,591 | A * | 10/1999 | Schluter | 52/11 |
| 6,050,030 | A * | 4/2000 | Wax, Sr. | 52/15 |
| 6,164,019 | A * | 12/2000 | Salley | 52/11 |
| 6,226,941 | B1 * | 5/2001 | Stevens | 52/302.3 |
| 6,279,271 | B1 * | 8/2001 | Burkart, Jr. | 52/11 |
| 6,421,967 | B1 * | 7/2002 | Wlaker | 52/198 |
| 6,688,059 | B1 * | 2/2004 | Walker | 52/302.3 |
| 6,886,302 | B2 * | 5/2005 | Jackson | 52/302.3 |
| 6,935,074 | B2 * | 8/2005 | Gramling | 52/11 |
| 7,051,485 | B2 * | 5/2006 | Burnette | 52/578 |
| 7,234,281 | B2 * | 6/2007 | Hauck | 52/302.3 |
| 7,434,358 | B2 * | 10/2008 | Smith | 52/14 |
| 2003/0074850 | A1 * | 4/2003 | Ready et al. | 52/302.1 |
| 2004/0035069 | A1 * | 2/2004 | Jackson | 52/302.1 |
| 2004/0231260 | A1 * | 11/2004 | Burkart | 52/302.1 |

* cited by examiner

*Primary Examiner* — Brian Glessner
*Assistant Examiner* — Joshua Ihezie
(74) *Attorney, Agent, or Firm* — Rodgers & Rodgers

(57) ABSTRACT

A ceiling drainage system disposed beneath an outdoor deck wherein the deck includes a frame structure supporting multiple parallel deck floor panels and the drainage system includes a U-shaped frame structure secured to the deck frame with multiple interlocking drain trays having one end secured to the drainage system U-shaped frame structure, a gutter extending between the free ends of the U-shaped frame structure, and the opposite ends of the drain trays interlocked with the gutter.

9 Claims, 5 Drawing Sheets

UNDER A DECK CEILING DRAINAGE SYSTEM

The benefits under 35 USC 119 are claimed of provisional patent application 61/194,615 filed Sep. 29, 2008.

BACKGROUND OF THE INVENTION

Outdoor decks which are typically attached to a residence are quite popular and are normally accessible from a second or higher level of the home. This leaves the space beneath the deck for use as an additional living area or even as a storage area. A conventional deck is made of parallel deck boards which inherently include spaces between the boards. Of course, this causes a problem when rain falls through the spaces and makes the area underneath the deck virtually unusable.

A variety of systems have been devised to catch water flowing between the deck boards. One problem with many known systems is that they are attached directly to the underside of the deck which causes them to follow the contour of the deck. If the deck is uneven, this is mirrored in an uneven condition in the drainage system resulting in the undesirable accumulation of water in the system low spots that is not drained away through the system. Another problem with many known systems is that when repairs are necessary, such as when a particular part must be repaired or replaced, either the gutter must be lowered or the drainage panels removed in reverse order of installation for the purpose of repairing or replacing the worn or damaged part.

SUMMARY OF THE INVENTION

By this invention, a system is provided to drain and remove rainwater which falls between the parallel floor panels of a conventional outdoor deck. The system is positioned under the deck and forms a ceiling structure for the space disposed below the deck and comprises a three-sided frame structure with a conventional gutter positioned on the fourth side such that the quadrilateral structure generally conforms to the outer perimeter of the deck. The system further comprises multiple side-by-side parallel drain trays which are interlocked and span the underneath area of the deck. Each of the drain trays is secured to the frame structure so that one end is attached to the frame member disposed adjacent the sidewall of the building to which the deck is attached with the opposite end being interlocked with the gutter positioned opposite from the building. The drain trays are appropriately sloped toward the gutter so that rainwater falling between the individual deck floor panels drops into the drain trays and flows toward the gutter and then away from the building.

DETAILED DESCRIPTION OF THE INVENTION

Figure 1:
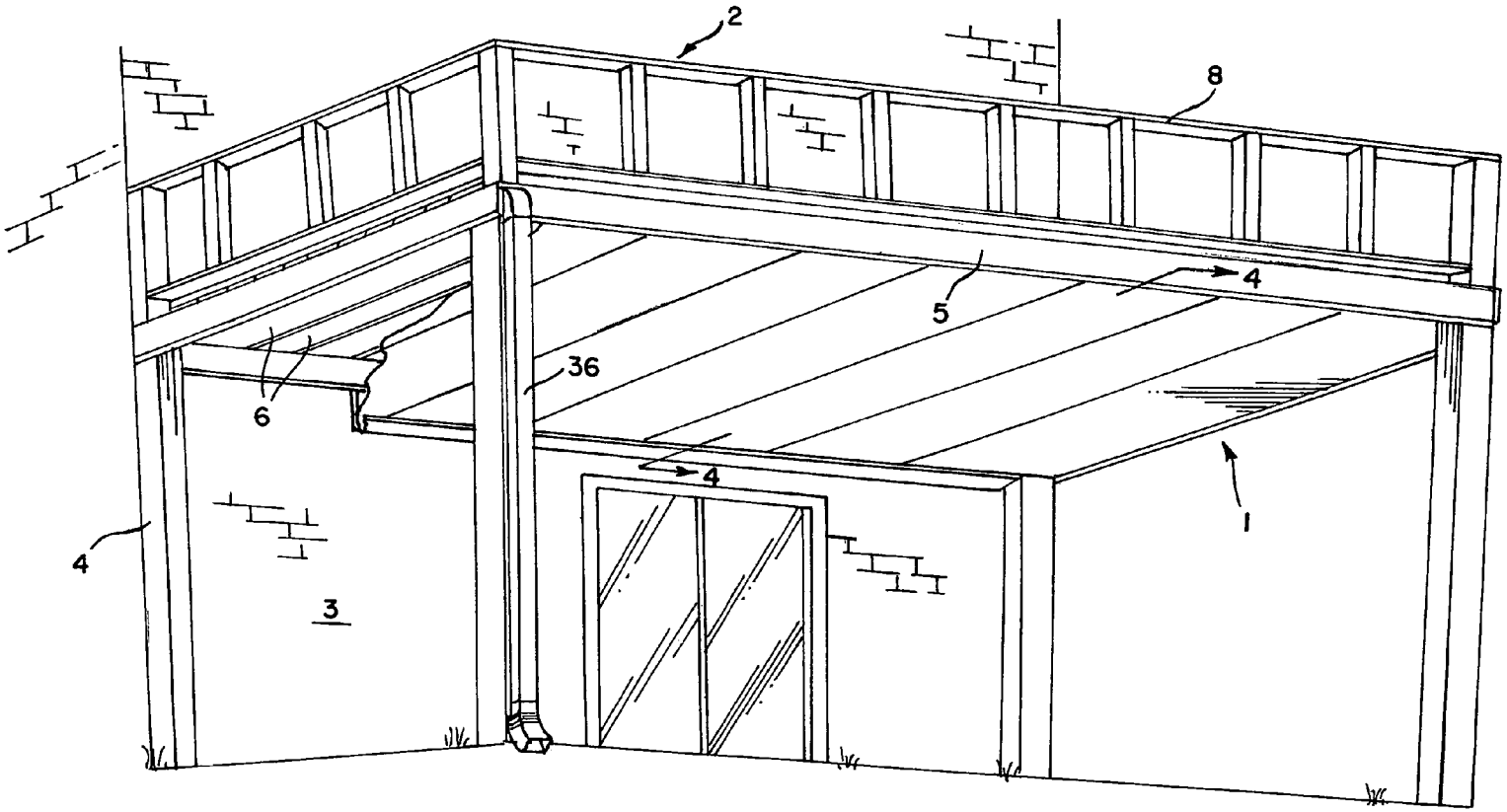
FIG. 1 is a perspective view of the under a deck drainage system according to this invention.
Figure 3:
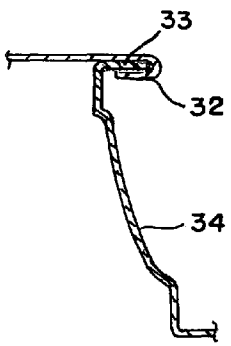
FIG. 3 is a cross-sectional view taken along the line 3-3 in FIG. 2.

In the drawings and with particular reference to FIG. 1, the ceiling drainage system, according to this invention, is positioned under an outdoor deck and is generally designated by the numeral 1. The outdoor deck is generally indicated by the numeral 2 and is secured in a conventional manner to building sidewall 3. Deck 2 includes four corner posts 4 with four end panels 5 extending between and secured to the upper ends of respective corner posts 4. Parallel joists 6 extend between the associated end panels 5. To complete the basic deck structure, multiple deck floor panels 7 are disposed 90 degrees with respect to joists 6 and are secured thereto with hand railing 8 extending around deck 2. The outdoor deck described herein is of conventional construction, although this invention is equally applicable to deck structures of other designs.

Figure 2:
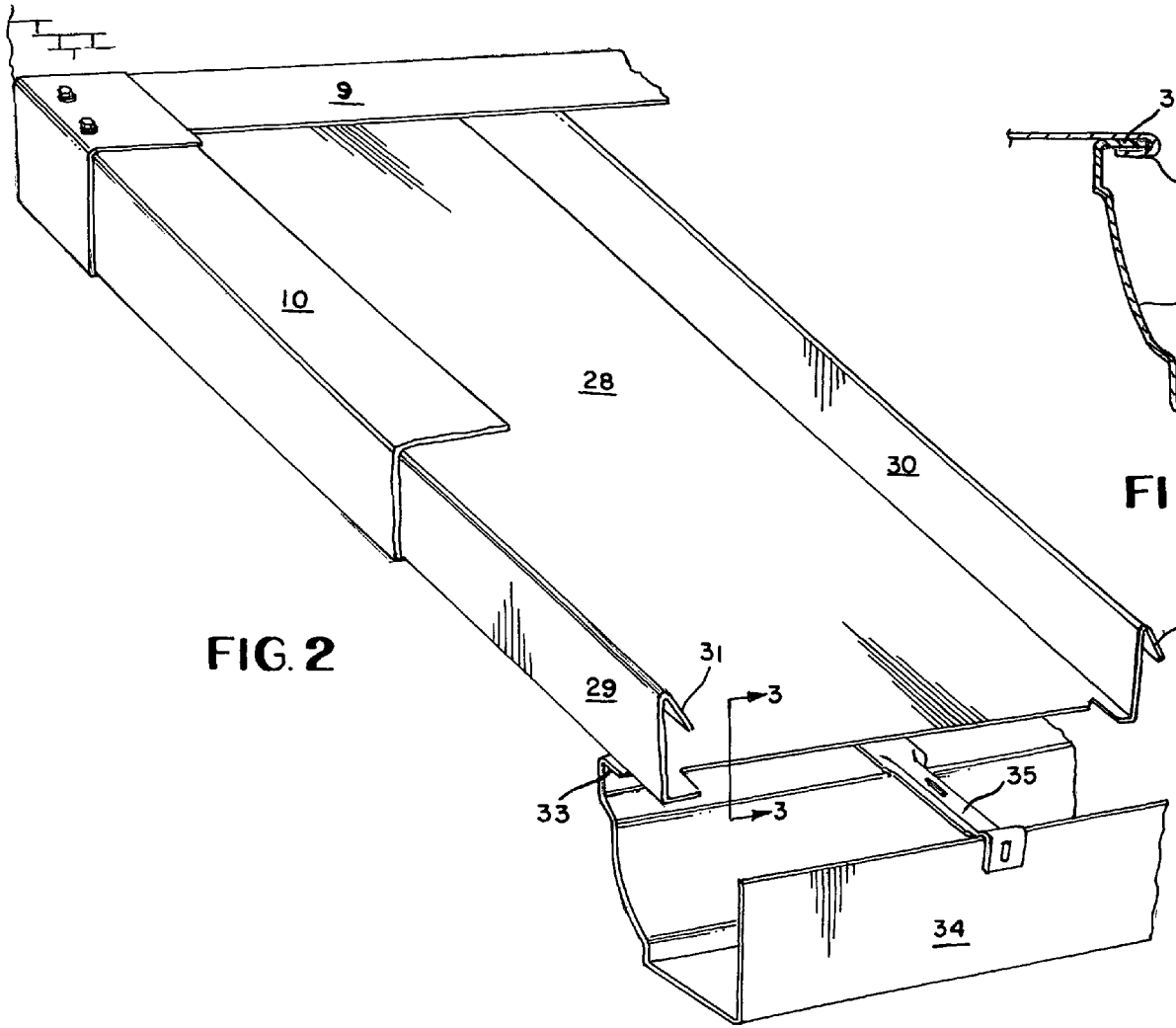
FIG. 2 is an enlarged partial perspective view of the drain tray and gutter combination.

The support structure for drainage system 1 is provided in part in the form of rear U-shaped bracket 9 and a pair of opposed side U-shaped brackets 10 extending 90 degrees, respectively, from the ends of rear U-shaped bracket 9 outwardly from building sidewall 3. Rear bracket 9 is attached to the associated end panel 5 positioned thereabove by any suitable means such as nailing. Although only one side U-shaped bracket 10 is shown in FIG. 2, it is understood that an identical U-shaped bracket is positioned on the opposite side of drainage system 1.

Figure 5:
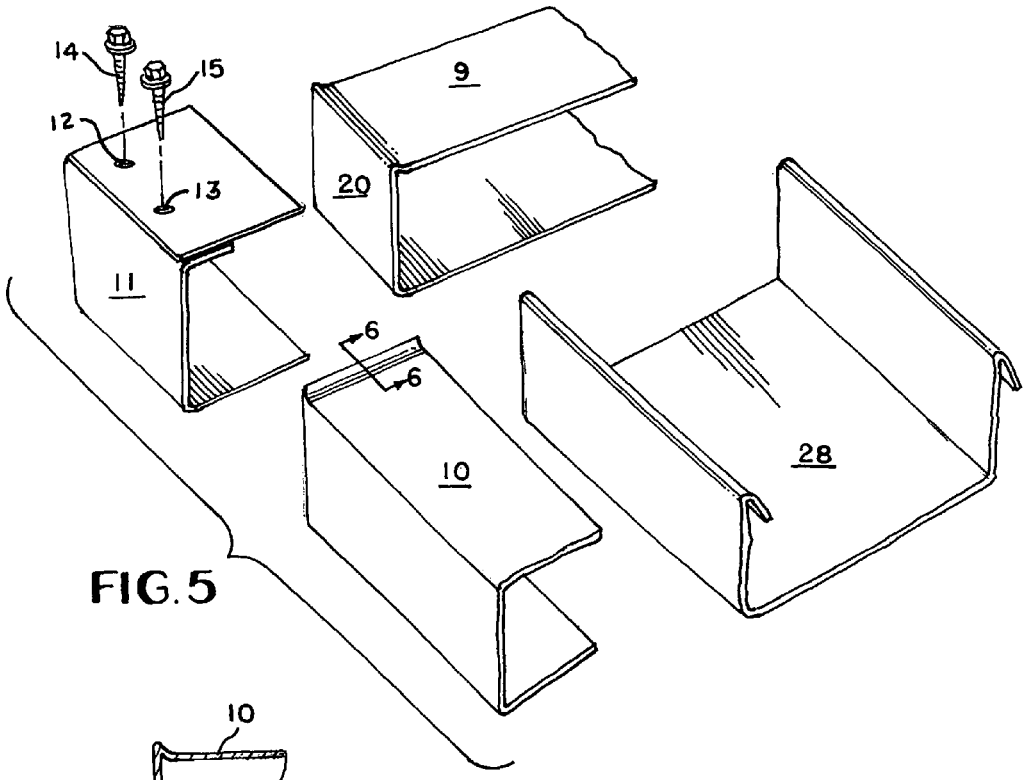
FIG. 5 is an exploded perspective view of one of the drainage system corner boxes.
Figure 10:
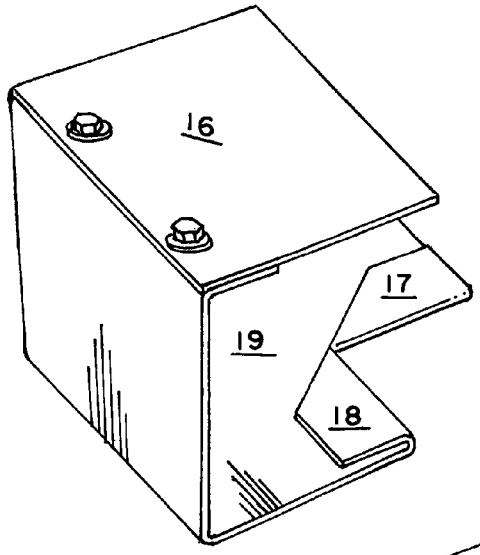
FIG. 10 is a perspective view of a modification of the drainage system corner box.
Figure 11:
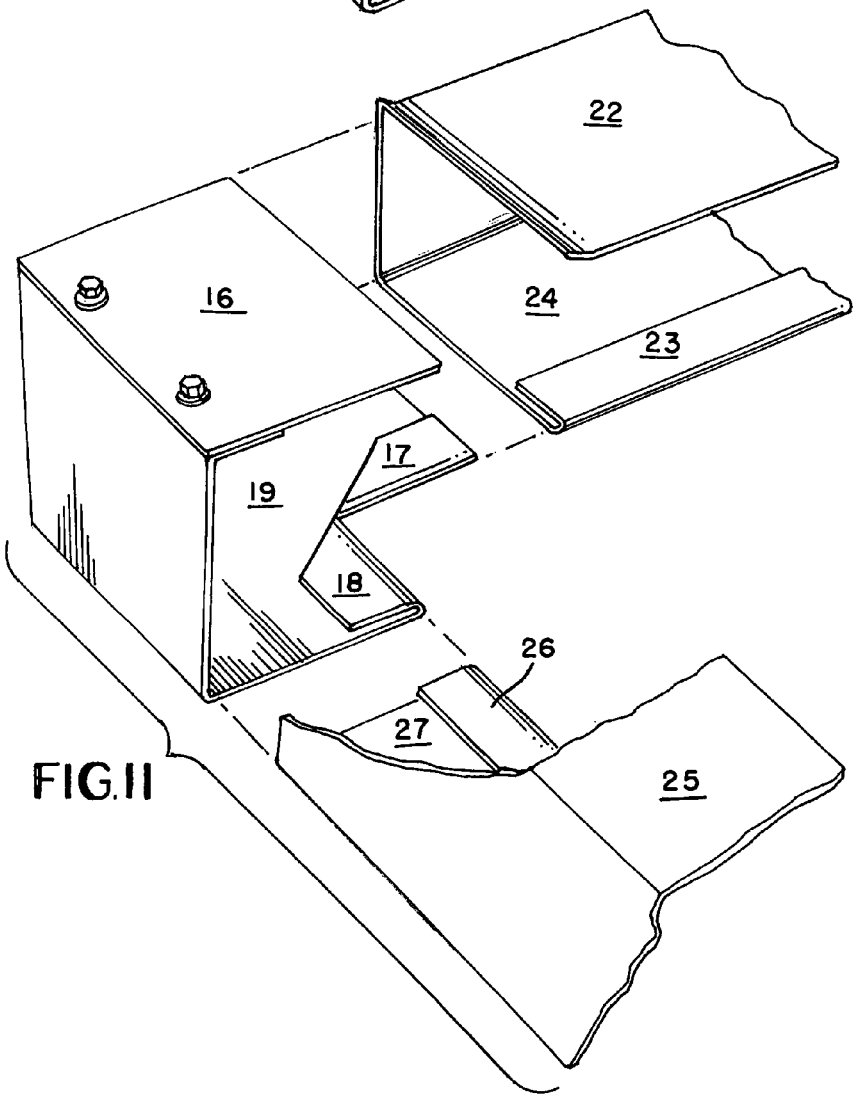
FIG. 11 is an exploded partial perspective view of the corner box shown in FIG. 10.

One version of the corner support means for drainage system 1 is shown in FIG. 5 and includes corner box 11 with apertures 12 and 13 formed therein. Corner box 11 is fabricated from a unitary piece of sheet metal which is successively folded to form the complete corner box 11 and which, in turn, is secured together by inserting screws 14 and 15 through apertures 12 and 13, respectively. A modification of the corner support means is shown in FIGS. 10 and 11 in the form of corner box 16 which essentially embodies the same features as corner box 11 with the exception of tabs 17 and 18 which are formed by making a diagonal cut from the outer corner of bottom member 19 of corner box 16. After the diagonal cut is made, tabs 17 and 18 are folded upwardly and over so as to overlie the upper surface of bottom member 19. The purpose of tabs 17 and 18 is to prevent water leakage at the inner corners of drainage system 1.

Figure 6:
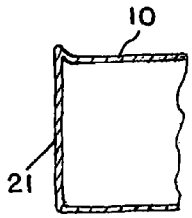
FIG. 6 is a cross-sectional view taken along line 6-6 in FIG. 5.
Figure 7:
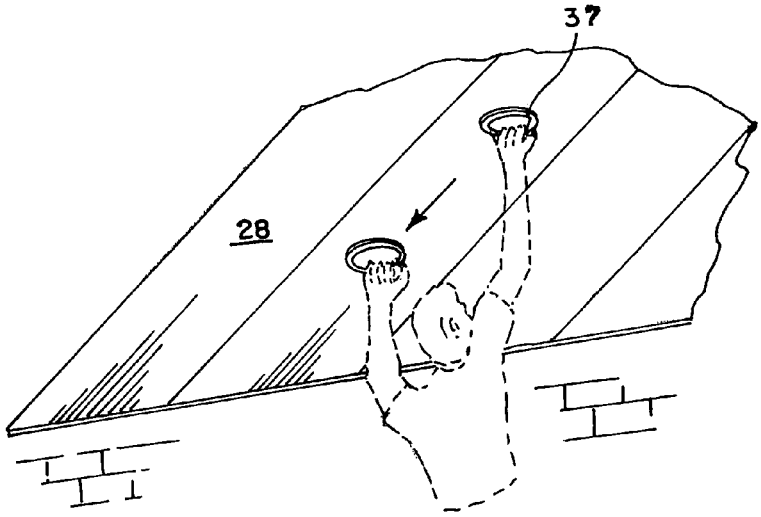
FIG. 7 is a partial perspective view depicting installation or removal of a drain tray.
Figure 8:
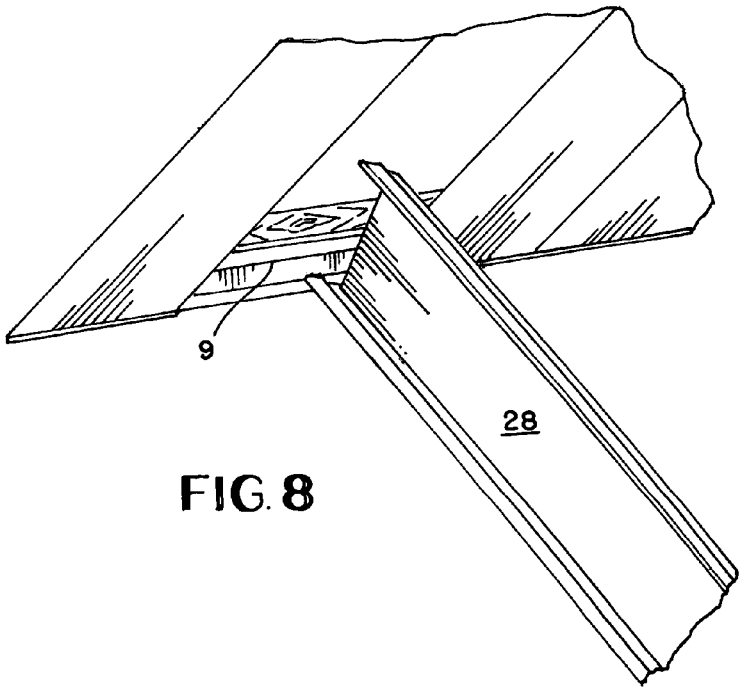
FIG. 8 is a partial perspective view showing removal of a drain tray.

In order to complete the framework for drainage system 1, each end of rear U-shaped bracket 9 is positioned within the respective corner box 11 and, in like manner, one end of each side of U-shaped bracket 10 is positioned perpendicular to U-shaped bracket 9 within the respective corner box 11, as best shown in FIG. 5. With respect to corner box 16, both U-shaped brackets are disposed between respective tabs 17 and 18 and bottom member 19. Of course, the sequence of positioning rear bracket 9 and side brackets 10 within corner boxes 11 and 16 can be accomplished in the reverse order. As shown in FIG. 6, the ends of the top wall of side brackets 10 positioned closest to building sidewall 3 are curved upwardly so as to direct water away from building sidewall 3. This same structural feature is embodied on the ends of U-shaped bracket 9.

In connection with the version of rear bracket 9 and side brackets 10, shown in FIG. 5, end panels 20 and 21 are formed on the ends thereof, respectively, so as to form an enclosed bracket structure for the purpose of preventing undesired water leakage. An alternative means of preventing leaking is shown in connection with the bracket structure shown in FIG. 11 wherein open-ended rear U-shaped bracket 22 includes rim 23 which is integrally joined to and overlies bottom panel 24. In like manner, open-ended side U-shaped bracket 25 includes rim 26 integrally joined to bottom panel 27. Therefore, when rim 23 is positioned between tab 17 and bottom member 19, and rim 26 is positioned between tab 18 and bottom member 19, water remains within the drainage system.

Referring to FIG. 2, the drain tray, according to this invention, is shown and includes bottom panel 28 with spaced sidewalls 29 and 30 upstanding from the side edges thereof. To complete the drain tray structure, interlocking strips 31 are integrally joined to the upper edges of sidewalls 29 and 30 and extend angularly downwardly therefrom in a parallel disposition to each other.

Figure 4:
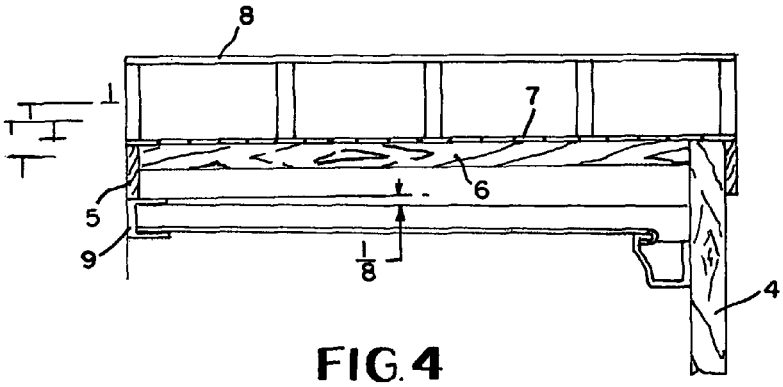
FIG. 4 is a cross-sectional view taken along the line 4-4 in FIG. 1.

In accordance with a feature of this invention, locking lip 32 is formed on the outer end edge of bottom panel 28 by making two spaced cuts in the outer end of bottom panel 28 and bending locking lip 32 downwardly through an arc of 180 degrees. Locking lip 32 envelops strip 33 which is integrally joined to the upper edge of one wall of conventional gutter 34 and which includes strengthening bracket 35. Gutter 34 is attached to outer corner posts 4 of deck 2, in known fashion, such as by nailing and the like and includes downspout 36. For the purpose of installation of drainage system 1, gutter 34 is positioned below the level of oppositely disposed rear U-shaped bracket 9 or 22 to allow for a pitch of one-eighth inch per foot for proper water drainage and as depicted in FIG. 4.

Figure 9:
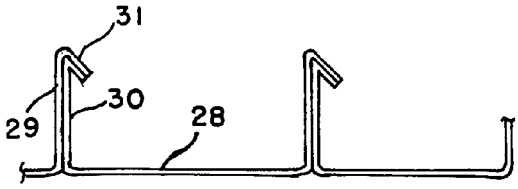
FIG. 9 is an end elevational view showing the interlocking means for the drain trays.

In practice, the installer utilizes conventional vacuum grippers 37 to position the first drain tray within rear bracket 9 or 22 and associated side bracket 10 or 25 and into the associated corner box, as best shown in FIGS. 2 and 11. End panels 20 and 21 are then disposed in face contacting relation with the associated panel of the corner box. Following this, the drain tray is maneuvered away from building sidewall 3 and back again so that locking lip 32 envelopes strip 33 of gutter 34. Then successive drain trays are positioned side by side into interlocking relation with one interlocking strip 31 positioned over interlocking strip 31 of the adjacent drain tray and into interlocking face contacting relation therewith, as best shown in FIG. 9. The final drain tray is positioned in the opposite side U-shaped bracket 10 or 25 and drainage system 1 then appears as shown in FIG. 1.

Therefore, by this invention, a ceiling drainage system for use under a deck prevents any water from dripping onto persons or furniture disposed below the deck by means of all the water falling between the deck panels onto drain trays and then flowing into a gutter whereby the water is diverted away from the building to which the deck is attached. Since the deck panels are not attached directly to the deck, as in known systems, each drain tray is easily removed for the purposes of repair or replacement by simply reversing the installation process and without the necessity of disassembling the entire drainage system. In addition, since the drainage system is not attached directly to the deck, it does not mirror irregularities in the deck itself which causes undesirable water accumulation in the drainage channels and allows the drainage system to be pitched at the minimum effective level which enhances the appearance of the under a deck drainage system.

The invention claimed is:

1. A drainage system disposed under an outdoor deck comprising a frame structure including a generally U-shaped bracket apparatus, a gutter extending between the free ends of said U-shaped bracket apparatus to form a quadrilateral structure, said gutter disposed below the horizontal level of said U-shaped bracket apparatus, multiple interlocking drain trays disposed perpendicular to said gutter with one end of each drain tray being positioned within said U-shaped bracket apparatus, the opposite end of each drain tray being interlocked with said gutter, said U-shaped bracket apparatus comprising a rear bracket having a pair of oppositely disposed end portions, said end portions of said rear bracket extending respectively into corner boxes, said corner boxes being fabricated from a single sheet of metal, said corner boxes comprising a bottom member, and a tab joined to and overlying said bottom member.

2. A drainage system according to claim 1 wherein said drain tray comprises a bottom panel, said bottom panel comprising spaced side edges, a pair of upstanding sidewalls joined respectively to said side edges, and a pair of interlocking strips joined respectively to the upper edges of said upstanding sidewalls and extending downwardly therefrom.

3. A drainage system according to claim 2 wherein said interlocking strips are parallel.

4. A drainage system according to claim 1 wherein a locking lip is formed on said bottom panel at said opposite end of said drain tray.

5. A drainage system according to claim 4 wherein said gutter comprises a pair of spaced walls having upper edges, a strip is, integrally joined to one of said upper edges, and said locking lip envelops said strip.

6. A drainage system according to claim 1 wherein said U-shaped bracket apparatus comprises a rear bracket having ends, a pair of side brackets extending 90 degrees respectively from said ends of said rear bracket.

7. A drainage system according to claim 1 wherein said side brackets include ends disposed respectively adjacent said ends of said rear bracket and said ends of said side brackets extend respectively into said corner boxes.

8. A drainage system according to claim 1 wherein one of said brackets comprises a bottom panel and a rim joined to and overlying said bottom panel.

9. A drainage system according to claim 8 wherein said rim is disposed between said bottom member and said tab.

* * * * *